United States Patent [19]

Csösz

[11] 4,087,114

[45] May 2, 1978

[54] TOE IRON

[75] Inventor: Gabor Csösz, Leonberg-Gebersheim, Germany

[73] Assignee: Vereinigte Baubeschlagfabriken Gretsch & Co. GmbH, Leonberg, Germany

[21] Appl. No.: 748,735

[22] Filed: Dec. 9, 1976

[30] Foreign Application Priority Data

Dec. 23, 1975 Germany ..... 2558339

[51] Int. Cl. ..... A63c 9/08

[52] U.S. Cl. ..... 280/625; 280/629

[58] Field of Search ..... 280/625, 629

[56] References Cited

U.S. PATENT DOCUMENTS 3,685,849 8/1972 Marker ..... 280/629

3,840,240 10/1974 Covini ..... 280/629

3,910,592 10/1975 Sittman ..... 280/625

*Primary Examiner*—Robert R. Song

[57] ABSTRACT

A safety toe clamp for a ski binding is disclosed wherein a ski boot sole holder is pivotally mounted for lateral movement on a body member provided with adjustable spring means urging said sole holder in a forward direction. Each of a pair of surfaces on said body member is each oppositely disposed outside of the central axis of the body member and adapted to cooperate with corresponding surfaces on the sole holder, the cooperating surfaces respectively being adapted to form a first swivel axis separated from the central axis of the toe clamp upon the application of an initial lateral force, and a second swivel axis upon application of further lateral movement of the sole holder.

5 Claims, 5 Drawing Figures

TOE IRON

BACKGROUND OF THE INVENTION

The invention relates to a safety toe iron for a ski binding with a sole holder which can be laterally swung out about in each case one perpendicular swivel axis located to the right and left of the longitudinal central axis, whereby a spring tension acts on said sole holder in the forward direction between the swivel axes.

With known safety toe irons of this type (DOS NO. 2,359,490, Austrian application No. 9991/72) the lateral swivel axes for the sole holder are arranged in such a way that in the case of lateral stressing up to a particular rotation angle of the sole holder about one of the pins the boot tip cannot be removed from the binding, whereby at the end of the lateral action of the springs the sole holder and therefore also the boot is returned to the axial position. If the swinging out of the sole holder, due to the action of the lateral forces is greater than the rotation angle, then the boot tip can be removed laterally from the binding, so that the connection with the ski is broken.

In the case of the known safety toe irons the spring tension must be regulated in such a way that a lateral swinging out of the sole holder is only possible when a dangerous starting torque acts on the leg of the skier. However, if parts of the binding are frozen solid or if an excessive forwardly directed pressure exerted by the heel iron which cooperates with the toe iron acts on the latter, then the release characteristics of the toe iron are significantly changed and the leg can be broken, despite the correct presetting of the initial tension of the springs in the toe iron.

BRIEF SUMMARY OF THE INVENTION

The problem of the present invention is a safety toe iron of the type defined hereinbefore which provides a reliable release at the given lateral force value even if the binding is frozen solid, if an excessive pressure is exerted by the heel or if other criteria exist which have a negative influence on the release characteristics, but which nevertheless still has the typical high lateral elasticity of such toe irons.

According to the invention this problem is solved in that the swivel axes are displaced outwards during the swinging out of the sole holder. This displacement should be 20 to 30%, but perferably 25% of the initial distance of the pivot axis from the longitudinal central axis. If the toe iron cooperates with a heel iron which exerts a pressure, according to the invention, as a function of the swivel angle the displacement is so large that the line of pressure application at least substantially runs through the outwardly displaced swivel axis when the sole holder reaches the angular position where the displaced swivel axis has just become effective.

Due to the construction according to the invention the first lateral release phase takes place when the lateral force is still completely harmless for the leg of the skier. The available reserves of force can be used for any frozen parts of the binding or for overcoming pressures which act against the release. If a certain small swivel angle has only been covered about the inner swivel axes the influences which hinder release are substantially eliminated. In this phase the swivel axis located further outwards is effective which, in view of the spring tension, is positioned in such a way that the lateral release of the sole holder takes place at the lateral force which is just tolerable to the leg of the skier. Therefore the final release can now take place at a clearly defined release value and proceeds unimpeded by other factors.

In practise the invention can be realized for example by the inner swivel axis being defined by a projection resting on a counter-surface, followed in the outwards direction by two rolling surfaces kept at a limited distance apart by the projection.

The sole holder is forced against the swival axes by a spring-loaded tie rod fixed in articulated manner thereto, whereby the tie rod articulation is located substantially between the swivel axes.

BRIEF DESCRIPTION OF THE DRAWINGS

Other and further objects of the present invention will be apparent from the following description and claims and are illustrated in the accompanying drawings, which by way of illustration, show preferred embodiments of the present invention and the principles thereof, and what are now considered to be the best modes contemplated for applying these principles. Other embodiments of the invention embodying the same or equivalent principles may be used and the structural changes may be made if desired by those skilled in the art, without departing from the invention and the scope of the appended claims. In the drawings show:

DETAILED DESCRIPTION OF THE PREFERRED EMBODIMENTS

Figure 1:
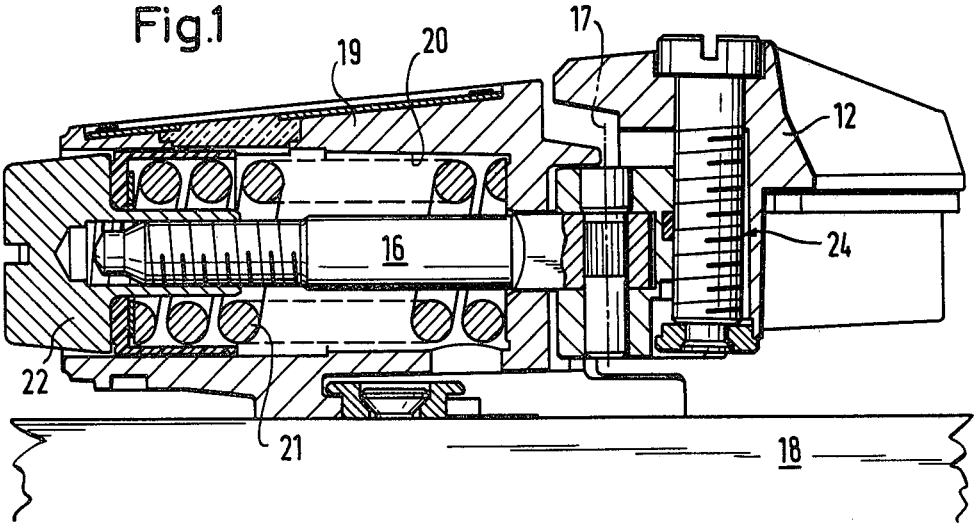
FIG. 1 a partly cutaway side view of a toe iron according to the invention.
Figure 2:
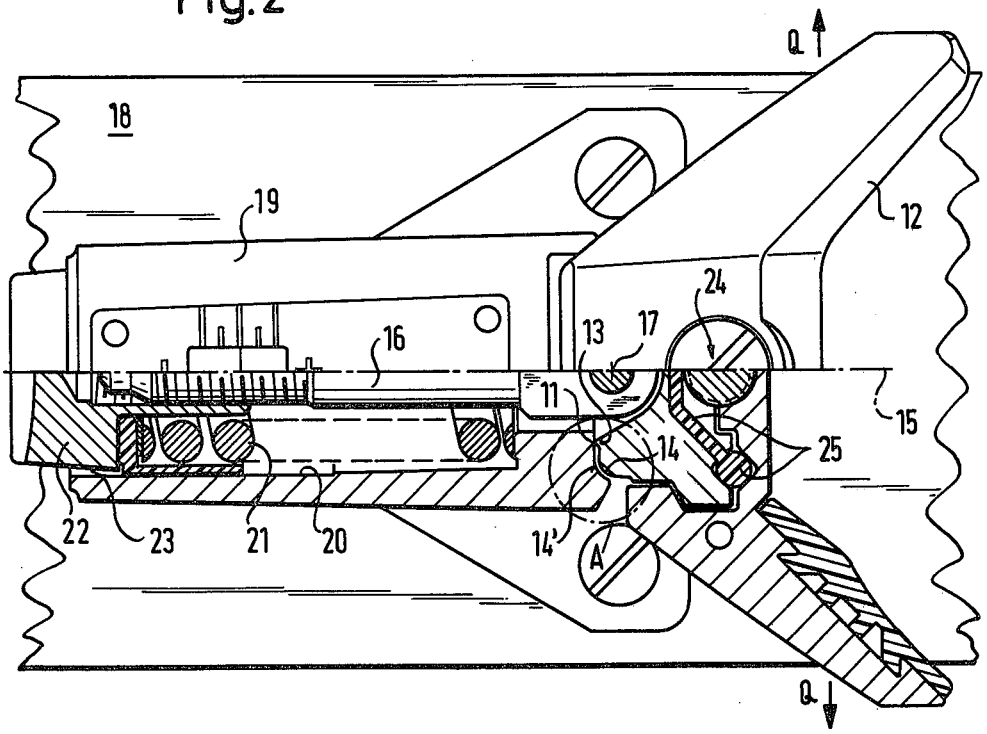
FIG. 2 a partly cutaway plan view of the object of FIG. 1.

According to FIGS. 1 and 2 the toe iron according to the invention is fixed in conventional manner to ski 18. A compression spring 21 is arranged in an axial recess 20 of casing 19, said spring acting on the end of the tie rod 16, which is to the left in the drawings. The abutment 22 of compression spring 21 is formed by a nut screwed onto tie rod 16, so that by screwing down abutment nut 22 to a greater or lesser extent onto tie rod 16 the initial tension of spring 21 can be present.

The end of spring 21, to the right in the drawings, is supported on casing 19.

As can be gathered from FIG. 2 an adequate gap 23 (FIG. 2) is provided between abutment nut 22 and casing 19, making possible the slight deflections to the left and right of tie rod 16 which occur in conjunction with the operation of the binding.

At the right end in the drawings at 17 pole holder 12 is pivotably connected about an axis which is perpendicular to the ski. The sole holder not only laterally retains the boot, but also holds down the sole thereof. A screw mechanism 24 permits a height adjustment of sole holder 12, so that the latter can be adapted to different boot sizes.

An elastic member 25 is positioned between the parts of sole holder 12 whose height relative to one another can be adjusted.

According to the invention symmetrically and on either side of the longitudinal central axis 15 are provided forwardly directed projections 13, constructed as vertical edges, which cooperate with an opposite surface of casing 19 in order to define a swivel axis 11 positioned perpendicularly on ski 18. An identical arrangement exists on the other side of the longitudinal central axis 15.

Two cooperating, arcuate surfaces 14, 14' curved in the indicated manner to one another and having a limited spacing from one another extend outwards from projection 13.

If a lateral force Q of predetermined size acts on sole holder 12 then the sole holder 12 initially rotates about the swivel axis 11 located on the relevant side of the lateral force Q, whereby spring 21 is compressed somewhat via connection 17 and abutment nut 22. Rotation continues until the two arcuate surfaces 14, 14' engage on one another, as is shown by dotted lines in FIG. 3. Further rotation now takes place round the swivel axis 11' positioned further outwards. The dimensioning of the individual parts and particularly projection 13 is such that on reaching the dotted position in FIG. 3 the pressure A produced by the heel iron runs substantially through the outer swivel axis 11', as is illustrated by a dotted arrow in FIG. 3. Whereas the pressure which acts in the normal position of FIG. 2 exerts a closing action on the toe iron, said closing moment substantially disappears in the swung out position of sole holder 12, shown by dotted lines in FIG. 3. On swinging out further the pressure gives rise to an opening moment.

Figure 4:
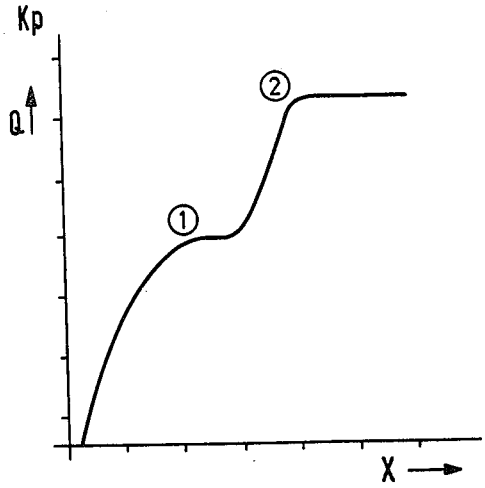
FIG. 4 the release characteristics of the binding of FIGS. 1 to 3.

In FIG. 4 the operation is shown graphically, the lateral force Q acting on the sole holder is plotted on the ordinate and the release path on the abscissa.

The first leg of the release curve extends from the start to stage "1," corresponding to the swinging out about inner swivel axis 11. However, the actual release force is only encountered level with stage "2," which only occurs when the arcuate surfaces 14, 14' engage with one another. The boot is only released on passing beyond stage "2." If during the release process the sole holder does not reach state "2," the toe iron is returned to its normal position when the lateral force disappears.

Thus, in the first part of the release path there is a relatively small lever arm between swivel axis 11 and pivotal connection 17, so that the first part of the release takes place relatively easily. On outwardly displacing the swivel axis the force which acts counter to the swinging out increases, in accordance with the diagram of FIG. 4. In the first stage of the release movement it is thus possible to break undesired connections of movable parts caused by icing, whilst simultaneously the overcoming of the closing moment resulting from the pressure action is facilitated.

The invention can also be used in the case of two separately pivotably arranged side irons. In addition, the toe iron could fundamentally also be used as a heel iron, provided that it cooperates with a suitable front binding.

Figure 3:
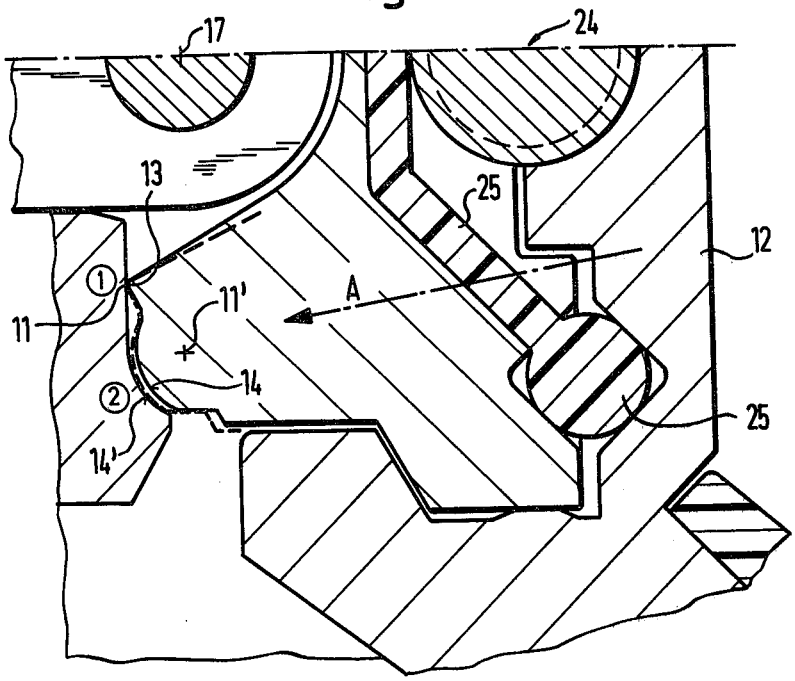
FIG. 3 a detail according to cutaway portion A of FIG. 2.
Figure 5:
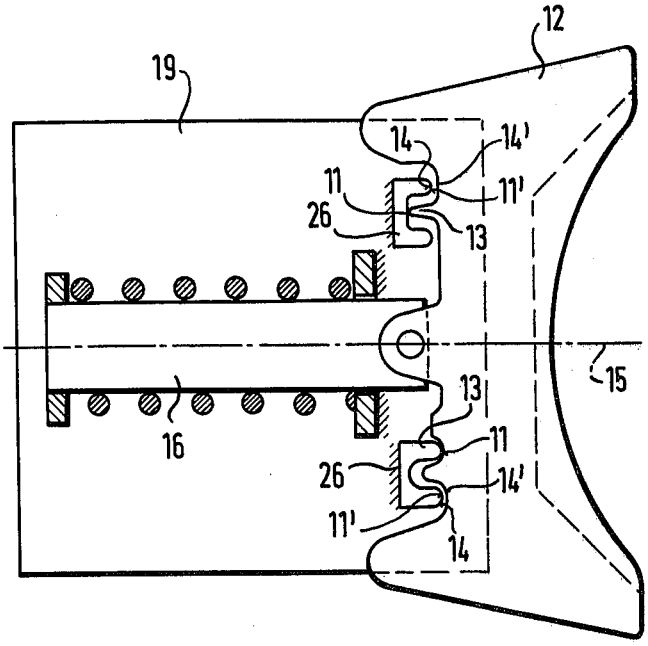
FIG. 5 a plan view of a second embodiment of the toe iron according to the invention.

FIG. 5 schematically shows that the invention can also be realized differently from the manner shown in FIGS. 2 and 3. In the embodiment shown above the longitudinal central axis 15 and projection 13 engages in a recess of a member 26 on casing 19. After a certain swinging path the further outwardly located arcuate surfaces 14, 14' engage with one another, whereby projection 13 is raised from the base of the recess.

Another embodiment is shown below axis 15, whereby in normal operation the inner projection 13 of member 26 cooperates with a corresponding recess on sole holder 12. On reaching a certain swivel angle the further outwardly located arcuate surfaces 14, 14' engage with one another to continue the swinging process.

The invention is not limited to the embodiments described and represented hereinbefore and various modifications can be made thereto without passing beyond the scope of the invention.

What is claimed is:

1. A safety toe clamp for a ski binding having a ski boot sole holder pivotally mounted for lateral movement and comprising a body member provided with adjustable spring means urging said sole holder in a forward direction into contact with said body member, said body member being provided with a pair of surfaces each oppositely disposed outside of said spring means and the central axis of said body member and each cooperating with corresponding surfaces provided on said sole holder, said cooperating surfaces respectively being adapted to form a first swivel axis on each side of the control axis during initial outward lateral movement of said sole holder in either lateral direction, and further adapted to form a second swivel axis on each side of the central axis and displaced laterally outwardly from said first swivel axis on the corresponding side of the central axis during further outward lateral movement of the sole holder, said second swivel axes being created by mutually cooperating arcuate surfaces on said body member and said sole holder and which surfaces are spaced apart during said initial outward lateral movement and engaged during said further outward lateral movement.

2. A clamp according to claim 1 wherein said second swivel axis is displaced from said first swivel axis by an amount of from about 20 to 30% of the distance between said first swivel axis and the central axis.

3. A toe clamp according to claim 1 which cooperates with a heel clamp provided with means to exert a forward force to the ski boot wherein the direction of the force intersects substantially said second swivel axis when the sole holder has reached an angular position at which said second swivel axis is first effective.

4. A toe clamp according to claim 1, wherein the sole holder is forced against said body member by a spring-loaded tie rod pivotally connected to said sole holder between said first swivel axes.

5. A toe clamp according to claim 1, wherein said first swivel axis is created by a projection on one of said cooperating surfaces engaging the other said surface in the rest position and during said initial outward lateral movement until said mutually cooperating arcuate surfaces come into engagement during said further outward lateral movement to create said second swivel axis.

* * * * *